US011761181B2

(12) United States Patent
Chen et al.

(10) Patent No.: US 11,761,181 B2
(45) Date of Patent: Sep. 19, 2023

(54) DRAWING FAUCET

(71) Applicant: FUZHOU RAJEYN ELECTRONIC SCIENCE TECHNOLOGY CO., LTD., Fujian (CN)

(72) Inventors: Junmin Chen, Fujian (CN); Shijie Peng, Fujian (CN); Yongshan Chen, Fujian (CN)

(73) Assignee: FUZHOU RAJEYN ELECTRONIC SCIENCE TECHNOLOGY CO., LTD., Fujian (CN)

( * ) Notice: Subject to any disclaimer, the term of this patent is extended or adjusted under 35 U.S.C. 154(b) by 213 days.

(21) Appl. No.: 17/322,233

(22) Filed: May 17, 2021

(65) Prior Publication Data

US 2022/0364339 A1 Nov. 17, 2022

(51) Int. Cl.
*E03C 1/04* (2006.01)
*E03C 1/05* (2006.01)

(52) U.S. Cl.
CPC ..... *E03C 1/0404* (2013.01); *E03C 1/057* (2013.01)

(58) Field of Classification Search
CPC ..... E03C 1/0404
USPC ..... 4/619–621, 615
See application file for complete search history.

(56) References Cited

U.S. PATENT DOCUMENTS 8,549,677 B2 * 10/2013 Weigen ..... E03C 1/057 4/313
11,566,404 B2 * 1/2023 Peng ..... E03C 1/0404

FOREIGN PATENT DOCUMENTS

CN 204878977 U 12/2015
CN 105496268 A * 4/2016 ..... E03C 1/06

* cited by examiner

*Primary Examiner* — Lori L Baker
(74) *Attorney, Agent, or Firm* — MUNCY, GEISSLER, OLDS & LOWE, P.C.

(57) ABSTRACT

A drawing faucet includes a drawing sensing structure. The drawing sensing structure includes sense marks and a sensor. The number of the sense marks is at least two, they are provided on the drawing hose at intervals along a length direction of the drawing hose. The sensor is configured to sense the movements of the sense marks. During a drawing process of the drawing hose, at least the sense marks at two ends along the length direction can follow the movement of the drawing hose and be sensed by the sensor. The automatic water discharge control unit correspondingly controls the water discharge to change the water discharge strategy according to the sensing signal of the sensor.

19 Claims, 9 Drawing Sheets

DRAWING FAUCET

TECHNICAL FIELD

The present disclosure relates to the technical field of faucets, and particularly, to a drawing faucet.

BACKGROUND

As a necessary equipment for daily production and domestic water use, faucets are widely used in kitchens, bathrooms and other places. The drawing faucets are widely used because their drawing head (usually a shower head) can be pulled out to different positions to meet the water demand of different positions, and they are convenient to use.

For the convenience of use, most of the existing drawing faucets are equipped with drawing sensing devices to realize automatic water out when the shower head is pulled out, and automatically turn off the water when the shower head is reset. For example, the public patent: CN204878977U discloses an intelligent control faucet. The drawing sensing device adopts a magnetic induction device. The magnetic induction device includes a Hall element and a magnetic activation mechanism that activates the Hall element. The Hall element is provided in the faucet body at one side opposite of the moving track of the magnetic activation mechanism, and is connected to the intelligent control module through a feeder or directly. The magnetic activation mechanism is provided on the drawing hose. The magnetic activation mechanism controls the on-off of the Hall element to control the connection between the discharge pipe and the drawing hose. The intelligent control faucet only uses a magnetic activation mechanism, and its control strategy is single. The existing single control strategy has the problem of: the shower head discharges the water as soon as it is pulled out, and the water is turned off after the shower head is reset. During the drawing process, the water is easy to sprinkle everywhere, affecting the user experience and being not conducive to water saving.

SUMMARY

The present disclosure is intended to provide a drawing faucet capable of realizing more flexible control strategies to solve the above-mentioned technical problems.

In order to achieve the above objective, the present disclosure provides a drawing faucet, comprising a faucet body, a drawing hose, an automatic water discharge control unit, and a drawing sensing structure; the drawing hose is retractably provided in the faucet body, and a water inlet end of the drawing hose is connected to a water outlet end of the automatic water discharge control unit; the drawing sensing structure comprises sense marks and a sensor; at least two sense marks are provided on the drawing hose and provided at intervals along a length direction of the drawing hose, the sense marks at two ends in the length direction are respectively defined as an upper sense mark and a lower sense mark; the sensor is configured to sense movements of the sense marks; during a drawing process of the drawing hose, at least the upper sense mark and the lower sense mark is able to follow a movement of the drawing hose and be sensed by the sensor, such that a first set of sensing signals and a second set of sensing signals are generated during a drawing process of the drawing hose, and the automatic water discharge control unit controls the water outlet end to change water discharge strategies accordingly based on the first set of sensing signals or the second set of sensing signals.

Further, the strategies to change the water discharge are to turn on the water discharge and to turn off the water discharge.

Furthermore, when two sense marks are provided, that the automatic water discharge control unit controls the water outlet end to change water discharge strategies accordingly based on the first set of sensing signals or the second set of sensing signals is specifically:

when the automatic water discharge control unit is in a state of turning off the water discharge, two sense mark movement signals at interval are the first set of sensing signals, and the water discharge is controlled to be turned on after a first sense mark movement signal is delayed after the second sense mark movement signal;

when the automatic water discharge control unit is in a state of turning on the water discharge, the two sense mark movement signals at interval are the second set of sensing signals, and the water discharge is controlled to be turned off after the first sense mark movement signal, and kept to be turned off and reset after the second sense mark movement signal.

Further, the sense mark is a switch-value sense mark, the sensor is a switch-value sensor; or the sense mark is a vectorial sense mark, the sensor is a vectorial sensor.

Furthermore, when the sense mark is selected as the switch-value sense mark, and the sensor is selected as the switch-value sensor, the sense mark is made of permanent magnet material, the sensor is a magnetic switch.

Furthermore, the magnetic switch is a reed switch or a Hall sensor.

Further, the permanent magnet has a ring structure and is fixedly sleeved on the drawing hose.

Further, when the sense marks are selected as the vectorial sense marks, and the sensor is selected as the vectorial sensor, the sense marks are made of permanent magnet materials with different magnetic fields, the sensor is a magnetic field detecting device.

Furthermore, the magnetic field detecting device is a Hall sensor.

Further, the permanent magnet has a ring structure and is fixedly sleeved on the drawing hose.

Further, when the sense mark is selected as the switch-value sense mark, and the sensor is selected as the switch-value sensor, the sense mark is a degaussing unit; the sensor comprises a magnetic unit and a magnetic switch, the magnetic unit and the magnetic switch are provided in the faucet body and are respectively located on opposite sides of the drawing hose; the magnetic switch is configured to sense the magnetic unit; when the degaussing unit is located between the magnetic unit and the magnetic switch, a sense of the magnetic switch to the magnetic unit is shielded.

Furthermore, the sense mark has a ring structure fixedly sleeved on the drawing hose.

Further, the magnetic switch is a reed switch or a Hall sensor.

Further, when the sense marks are selected as the vectorial sense marks, and the sensor is selected as the vectorial sensor, the sense marks are respectively composed of different magnetic poles of a magnet, and the sensor is a magnetic pole determiner.

Further, when the sense mark is selected as the switch-value sense mark, and the sensor is selected as the switch-value sensor, the sense mark is a color mark, and the sensor is a photoelectric sensor.

Furthermore, the sense mark is formed by arranging a color ring on an outer peripheral surface of the drawing hose, and a color of the color ring is different from a color of the drawing hose.

Furthermore, the color ring is formed by a sticker or paint.

Further, when the sense mark is selected as the vectorial sense mark, and the sensor is selected as the vectorial sensor, the sense mark is a color mark, and a color of each color mark is different, and the sensor is a photoelectric sensor.

The beneficial technical effects of the present disclosure are list below:

The present disclosure adopts at least two sense marks. The sense marks are provided on the drawing hose and provided at intervals along the length direction of the drawing hose. Compared with the prior art, a more flexible and changeable control strategy can be obtained, for example, the water coming out as soon as the drawing head is drawn out can be prevented, and the water is only turned off after the drawing head is reset, causing water to be scattered everywhere, and affecting the user experience, water saving can be not conducive.

BRIEF DESCRIPTION OF DRAWINGS

In order to more clearly describe the technical solutions in the embodiments of the present disclosure, the following will briefly introduce the drawings needed in the description of the embodiments. Obviously, the drawings in the following description are only some embodiments of the present disclosure. For those of ordinary skill in the art, without inventive work, other drawings can be obtained from these drawings.

DESCRIPTION OF EMBODIMENTS

To further illustrate the various embodiments, the present disclosure is provided with drawings. The drawings are a part of the present disclosure, and are mainly used to illustrate the embodiments, and can cooperate with the relevant description in the specification to explain the operation principle of the embodiments. With reference to these contents, those of ordinary skill in the art would be able to understand other possible implementation manners and advantages of the present disclosure. The elements in the figures are not drawn to scale, and similar element symbols are usually used to indicate similar elements.

The present disclosure will now be further described with reference to the drawings and specific embodiments.

Embodiment 1

Figure 1:
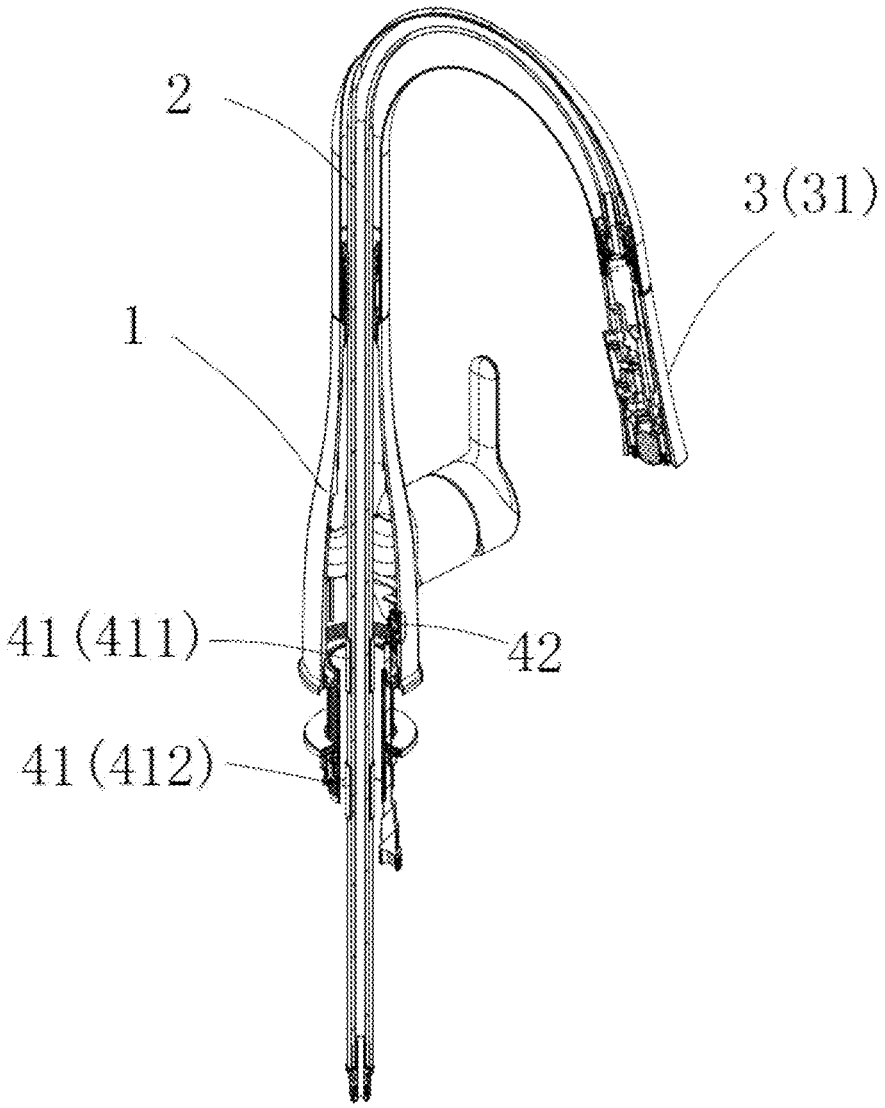
FIG. 1 is a cross-sectional structure diagram showing a drawing faucet according to the first embodiment of the present disclosure.
Figure 2:
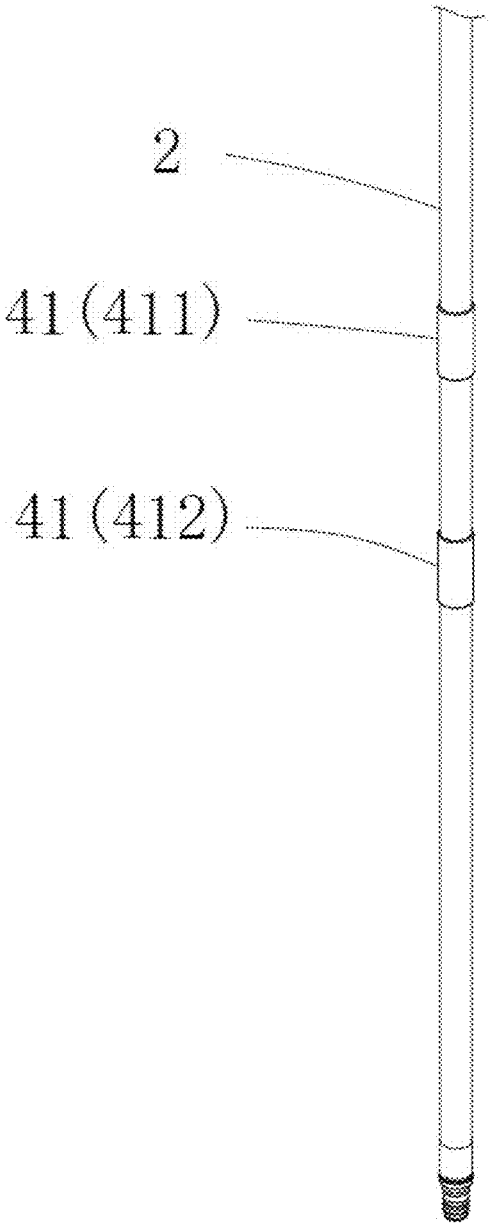
FIG. 2 is a structural diagram showing a drawing hose and a sense mark according to the first embodiment of the present disclosure.

As shown in FIGS. 1 and 2, the present embodiment discloses a drawing faucet, including a faucet body 1, a drawing hose 2, an automatic water discharge control unit 8, and a drawing sensing structure. The drawing hose 2 can be retractably provided in the faucet body 1, a water inlet end 21 of the drawing hose 2 may be connected with the water outlet end 81 of the automatic water discharge control unit 8, and the water outlet end of the drawing hose 2 may be connected with the drawing head 3. In the present embodiment, the drawing head 3 may be a shower head 31, but it is not limited to this. The shower head 31 can adopt various existing shower heads with drawing faucets. For the specific structure, please refer to the prior art, which will not be described in detail here.

The drawing sensing structure may include sense marks 41 and a sensor 42. The number of sense marks 41 may be at least two, they may be provided on the drawing hose 2 and may be provided at intervals along the length direction of the drawing hose 2. The sense marks 41 at two ends along the length direction may be defined as an upper sense mark 411 and a lower sense mark 412 respectively. The sensor 42 may be used to sense the movements of the sense marks 41. During a drawing process of the drawing hose, at least the upper sense mark 411 and the lower and lower sense mark 412 can follow the movement of the drawing hose 2 and may be sensed by the sensor 42, so that the drawing hose 2 generates a first set of sensing signals and a second set of sensing signals during the drawing process, respectively. The automatic water discharge control unit 8 correspondingly controls the water outlet end to change the water discharge strategy according to the first set of sensing signals or the second set of sensing signals.

In the specific embodiment, two sense marks 41 are provided, such as the upper sense mark 411 and the lower sense mark 412, respectively.

The upper sense mark 411 and the lower sense mark 412 of the embodiment may be both switch-value sense marks, and the sensor 42 may be a switch-value sensor.

In this embodiment, both the upper sense mark 411 and the lower sense mark 412 may be made of permanent magnetic materials, preferably made of permanent magnetic materials such as ferrite and neodymium iron boron, such that they are easy to be implemented and have low cost, but it is not limited to this.

Preferably, in the specific embodiment, both the upper sense mark 411 and the lower sense mark 412 may be of circular ring structure, and fixedly sleeved on the drawing hose 2. The circular ring structure is adopted for easy fixing, with good fixing strength, but not easy to fall off, but it is not limited to this. In other embodiments, the upper sense mark 411 and the lower sense mark 412 may also adopt other structures, such as a strip structure, a circular arc sheet structure, and the like.

The upper sense mark 411 and the lower sense mark 412 in FIGS. 1 and 2 are drawn using a simple drawing method and do not reflect the specific fixing structure. The fixing method of the upper sense mark 411 and the lower sense mark 412 can be fixed by various existing fixing structures. For example, the magnetic ring fixing structure in the published patent: CN204878977U may be adopted, please refer to the published patent: CN204878977U for details. Of course, in some other embodiments, the sense mark 41 can also be fixedly sleeved on the drawing hose at intervals by other methods such as bonding, welding, and the like.

The interval space between the upper sense mark 411 and the lower sense mark 412 can be adjusted and changed according to actual use experience. The interval space can affect and determine how long the shower head 31 is drawn to switch the water discharge control mode.

In this embodiment, the sensor 42 may be a magnetic switch, preferably a Hall sensor, with a simple structure, and it may be easy to implement, with a small size, but it is not limited to this. In some embodiments, the magnetic switch may also adopt other magnetic switches, such as reed switch and the like. The Hall sensor may be fixedly provided in the faucet body 1 and may be located at one side of the moving path of the upper sense mark 411 and the lower sense mark 412. The output terminal of the Hall sensor may be connected to the input terminal of the automatic water discharge control unit 8.

The automatic water discharge control unit 8 may include a control panel, a battery and a solenoid valve. The battery can supply power to the automatic water discharge control unit 8. The solenoid valve may be connected in series in the water discharge circuit of the drawing hose 2. The control end of the solenoid valve may be connected to the control output terminal of the control panel, and the output terminal of the Hall sensor may be connected to the input terminal of the control panel, and the more specific structure of the automatic water discharge control unit can refer to the existing automatic water discharge control unit of a faucet that senses water discharge.

In this specific embodiment, the strategy for changing the water discharge may be to turn on and turn off the water discharge, and the working principle is specifically as follows:

During the drawing process of the shower head 31 (at this time, the automatic water discharge control unit is in the state of turning off the water discharge), the drawing hose 2 may drive the upper sense mark 411 and the lower sense mark 412 to move upwards. When the shower head 31 is drawn out for a certain distance, the upper sense mark 411 and the lower sense mark 412 may be sensed when passing through the sensing area of the Hall sensor in turn, and output two sense mark movement signals at intervals (the first set of sensing signals) to the control panel of the water control unit. The control panel controls to turn on the water discharge only after the first sense mark movement signal is delayed to after the second sense mark movement signal, and the shower head 31 discharges water, such that the shower head 31 is drawn out for a certain distance before it discharges. In the process of retracting the shower head 31 (at this time, the automatic water discharge control unit is in a state of turning on water discharge), the upper sense mark 411 and the lower sense mark 412 move down. The lower sense mark 412 and the upper sense mark 411 may be sensed when passing through the sensing area of the Hall sensor, and output two sense mark movement signals at intervals (the second set of sensing signals) to the control panel of the automatic water discharge control unit. The control panel controls the solenoid valve to turn off the water discharge after the first sense mark movement signal, and maintains the shut down of the water discharge and resets the position after the second sense mark movement signal, to realize that the shower head 31 has turned off the water in advance during the reset process.

Of course, the reset function can also be set on the control panel. The program can be reset when the control panel controls the solenoid valve in a disorderly logic.

In some embodiments, the number of magnetic switches can also be two or more than two, etc., and a plurality of the magnetic switches may be used to sense the upper sense mark 411 and the lower sense mark 412 to achieve a redundant design and improve reliability. The principle can be referred to the patent: CN212429908U, which will not be elaborated here.

Embodiment 2

The hardware structure of the present embodiment is basically the same as that of the first embodiment, except that the automatic water discharge control unit correspondingly controls the water outlet to change the water discharge strategy according to the first set of sensing signals or the second set of sensing signals.

Specifically, in this embodiment, the strategy for changing the water discharge may be to increase the flow at the outlet and reduce the flow at the outlet (turning on and off the water flow can be controlled by the faucet handle and/or infrared sensor), but it is not limited to this. Of course In other embodiments, the automatic water discharge control unit can control its water outlet to change other water discharge strategies according to the first set of sensing signals or the second set of sensing signals accordingly.

Embodiment 3

Figure 3:
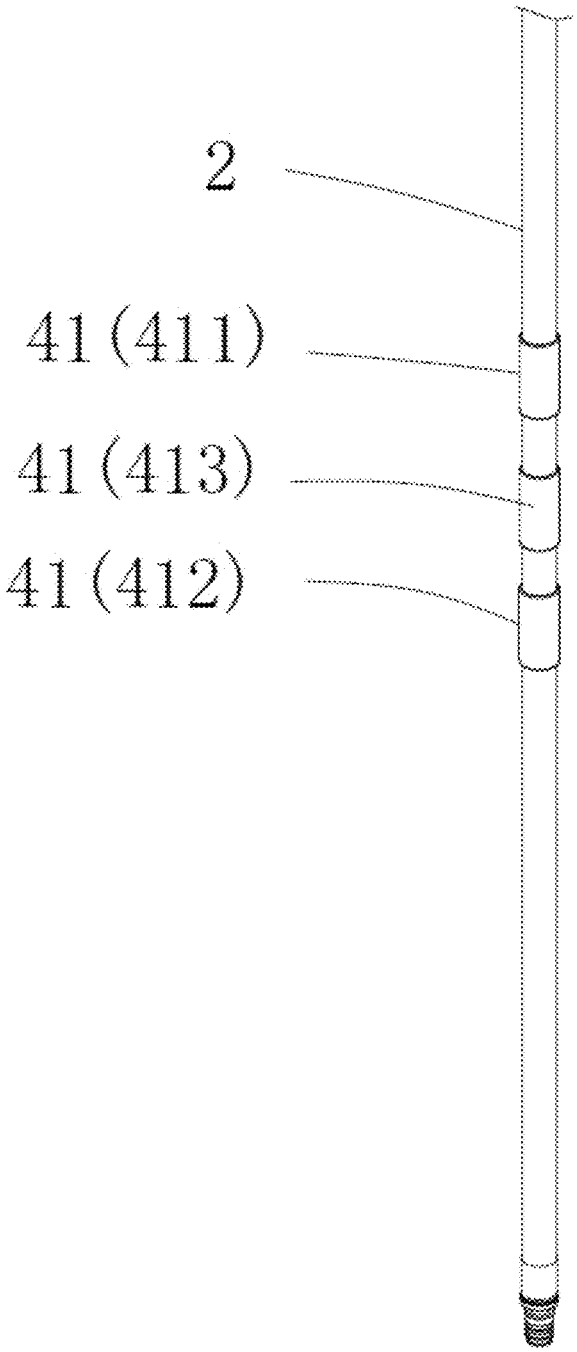
FIG. 3 is a structural diagram showing a drawing hose and a sense mark according to the third embodiment of the present disclosure.

Most elements of this specific embodiment are the same as those of the first embodiment. The main difference is: as shown in FIG. 3, the number of sense marks 41 in this embodiment may be three, such as, respectively, the upper sense mark 411, the middle sense mark 413 and the lower sense mark 412. The middle sense mark 413 may be used to assist the automatic water discharge control unit to control the water outlet to change the water discharge strategy, such as assisting in determining whether the drawing hose 2 is drawn out to a set length or retracted to the original position. Specifically, when the Hall sensor senses the upper sense mark 411, the middle sense mark 413 and the lower sense mark 412, and outputs three sense mark movement signals at intervals to the control panel of the automatic water discharge control unit. The automatic water discharge control unit determines that the drawing hose 2 is drawn out to the set length, or retracted to the original position, but it is not limited to this. In some embodiments, the middle sense mark can also be used for other control functions.

Of course, in other embodiments, the total number of sense marks 41 can also be more than 4, so as to implement a more complicated water discharge strategy.

Embodiment 4

Most elements of this specific embodiment are the same as those of the first embodiment. The main difference is that: the drawing sensing structure adopting the vector signal may be used to replace the drawing sensing structure adopting the switch-value signal. That is, both the upper sense mark and the lower sense mark may be all vectorial sense marks, and the sensor may be selected as a vectorial sensor.

Specifically, the upper sense mark and the lower sense mark may be respectively realized by using a smaller magnetic field permanent magnet and a larger magnetic field permanent magnet with different magnetic field magnitude.

The sensor may be a magnetic field detecting device that can detect whether it is an upper sense mark in a smaller magnetic field or a lower sense mark in a larger magnetic field by detecting the magnitude of the magnetic field, so as to determine whether the drawing hose is drawn out or retracted and reset. Specifically: when the upper sense mark is sensed first prior to the lower sense mark, the drawing hose is drawn out; otherwise, the drawing hose is retracted and reset. That is to say, the drawing sensing structure using the vector signal instead of the drawing sensing structure using the switch-value signal can additionally detect the moving direction of the drawing hose, so as to better perform the control of the on/off and/or opening of the solenoid valve, to achieve an accurate water discharge strategy, such that miscontrol can be avoided, and the user experience can be improved.

In this specific embodiment, the magnetic field detecting device can be realized by selecting the Hall sensor with analog output followed by an ADC module. The automatic water discharge control unit distinguishes the upper sense mark and the lower sense mark according to the numerical value of the ADC module, and then realizes the change of the water discharge strategy, but it is not limited to this.

Embodiment 5

Figure 4:
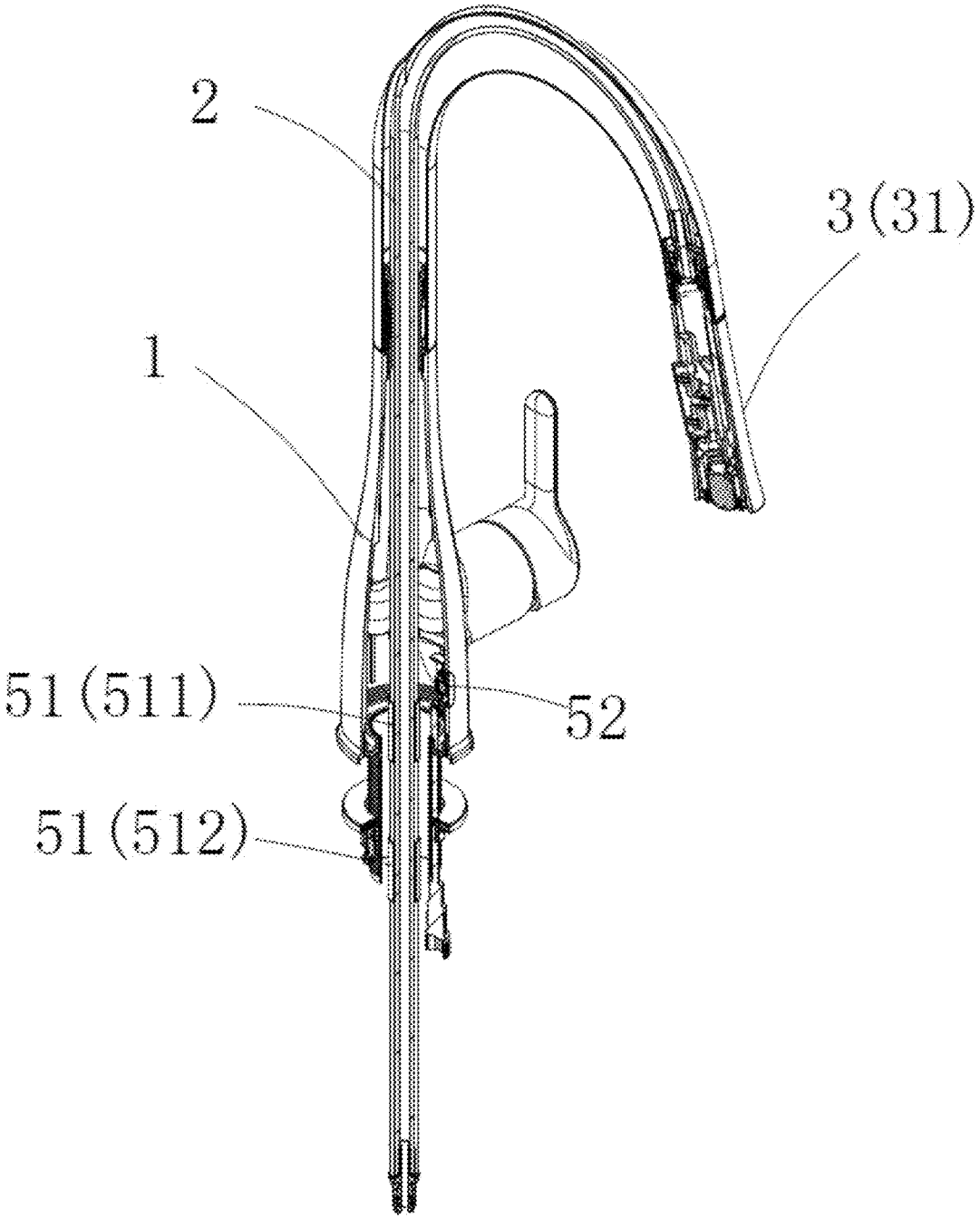
FIG. 4 is a cross-sectional structure diagram showing a drawing faucet according to the fifth embodiment of the present disclosure.
Figure 5:
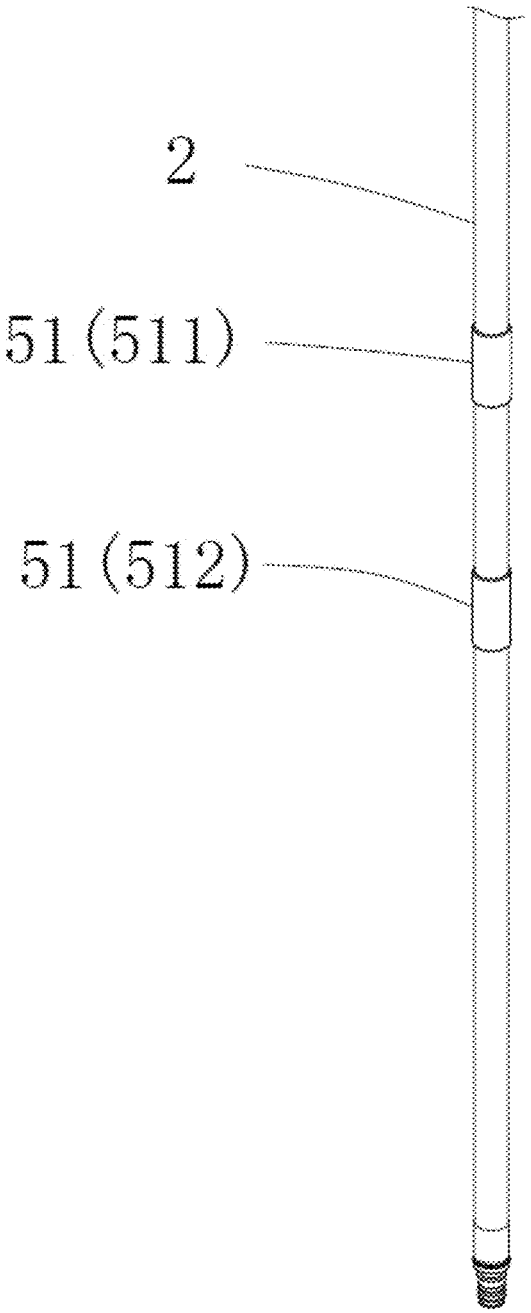
FIG. 5 is a structural diagram showing a drawing hose and a degaussing ring according to the fifth embodiment of the present disclosure.

As shown in FIGS. 4 and 5, most elements of this embodiment are the same as those of the first embodiment. The main difference is that: the sense mark 51 of this embodiment may be a degaussing unit, and the sensor may include a magnetic unit and a magnetic switch 52. The magnetic unit and the magnetic switch 52 may be provided in the faucet body 1 and may be respectively located at opposite sides of the drawing hose 2. The magnetic switch 52 may be used to sense the magnetic field of the magnetic unit. When the degaussing unit is located between the magnetic unit and the magnetic switch 52, the sense of the magnetic switch 52 to the magnetic unit may be shielded.

In this specific embodiment, both the upper sense mark and the lower sense mark may be of circular ring structure, hereinafter referred to as the upper degaussing ring 511 and the lower degaussing ring 512 that are fixedly sleeved on the drawing hose 2. They are easy to fix and have good fixed strength, and are not easy to fall off. However, it is not limited to this. In other embodiments, the sense mark 51 may also adopt other structures, such as a strip structure, a circular arc sheet structure, and the like.

The upper degaussing ring 511 and the lower degaussing ring 512 in FIGS. 4 and 5 are drawn in a simple way and do not reflect the specific fixing structure. The fixing method of the upper degaussing ring 511 and the lower degaussing ring 512 can be fixed by various existing fixing structures. For example, the fixing structure of the magnetic ring of the first embodiment may be used for fixing. Of course, in other embodiments, the upper degaussing ring 511 and the lower degaussing ring 512 can also be fixed and sleeved on the drawing hose by bonding, welding and other methods.

In this embodiment, the setting of the interval space between the upper degaussing ring 511 and the lower degaussing ring 512 can be adjusted and changed according to the needs of actual use experience. The interval space can affect and determine how long the shower head 31 is drawn to switch the water discharge control mode.

In this specific embodiment, the magnetic unit may be preferably made of permanent magnet material, which is easy to implement and low in cost, but it is not limited to this.

In this embodiment, the magnetic switch 52 may be preferably a Hall sensor with switch-value output, it is simple in structure, easy to implement, and small in size, but it is not limited to this. In some embodiments, the magnetic switch 52 may also use other magnetic sensors, such as a reed switch. The output terminal of the Hall sensor may be connected to the input terminal of the automatic water discharge control unit.

The working principle of this embodiment is:

During the drawing process of the shower head 31 (at this time, the automatic water discharge control unit is in the state of turning off water discharge), the drawing hose 2 drives the upper degaussing ring 511 and the lower degaussing ring 512 to move upwards. When the shower head 31 is drawn out for a certain distance, the upper degaussing ring 511 and the lower degaussing ring 512 may be sensed when passing through the sensing area of the Hall sensor in turn, and output two sense mark movement signals at intervals (the first set of sense signals) to the control panel of the water control unit. The control panel may control to turn on the water discharge only after the first sense mark movement signal is delayed until the second sense mark movement signal, and the shower head 31 discharges water, so that the shower head 31 is drawn out for a certain distance before it discharges. In the process of retracting the shower head 31 (at this time, the automatic water discharge control unit is in the state of turning on the water discharge), the upper degaussing ring 511 and the lower degaussing ring 512 move downwards, the lower degaussing ring 512 and the upper degaussing ring 511 may be sensed when passing through the sensing area of the Hall sensor in turn, and may output two sense mark movement signals at intervals (the second set of sense signals) to the control panel of the water control unit. The control panel controls the solenoid valve to turn off the water discharge after the first sense mark movement signal, and maintains the shut down of the water discharge and resets the position after the second sense mark movement signal, such that the shower head 31 can be turned off in advance during the reset process.

Of course, in some embodiments, the automatic water discharge control unit can also use other control logic to control the water discharge according to the sensing signal of the sensor.

Embodiment 6

Figure 6:
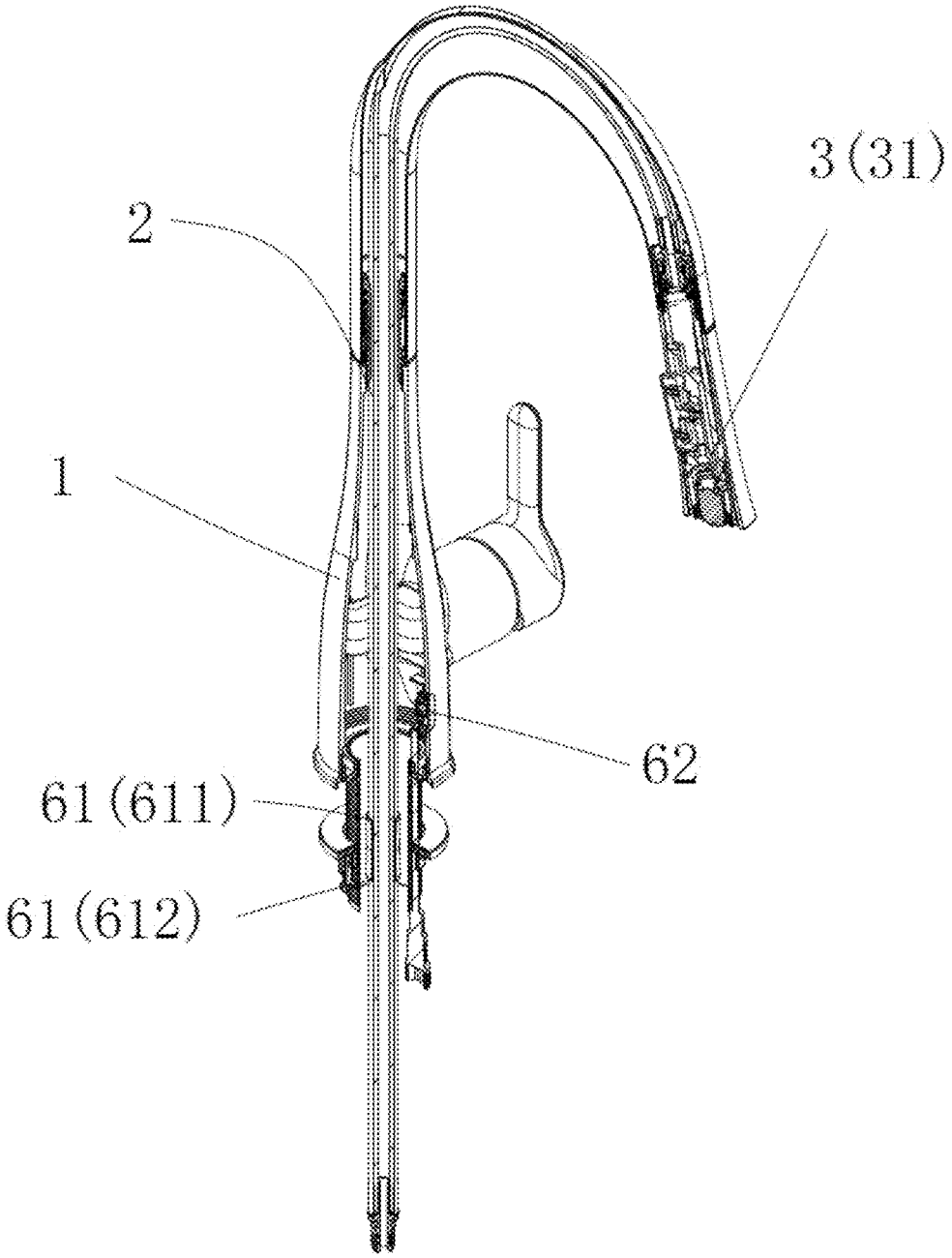
FIG. 6 is a sectional structural diagram showing a drawing faucet according to the sixth embodiment of the present disclosure.
Figure 7:
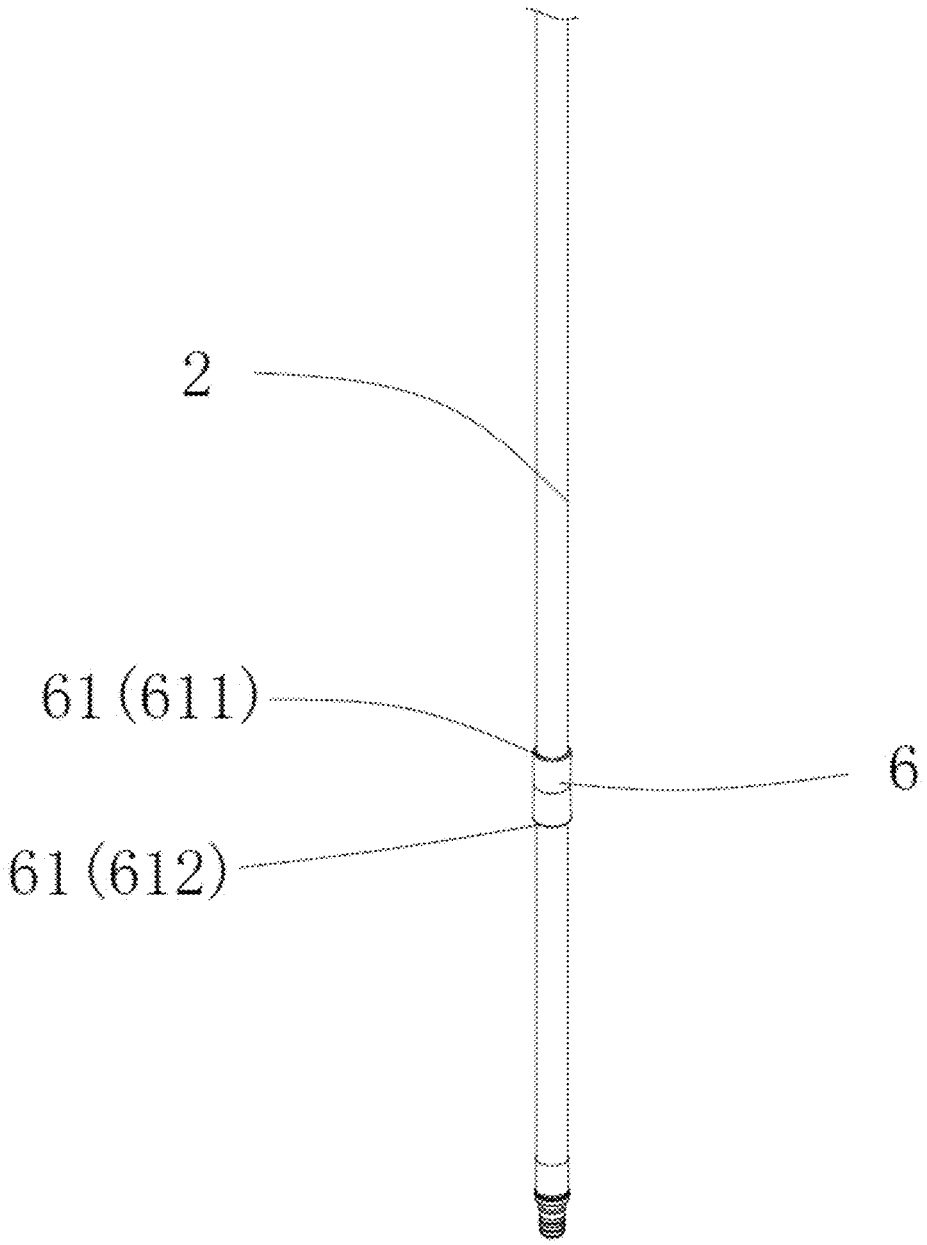
FIG. 7 is a structural diagram showing a drawing hose and a degaussing ring according to the sixth embodiment of the present disclosure.

As shown in FIGS. 6 and 7, most elements of this embodiment are the same as those of the first embodiment. The main difference is that: the drawing sensing structure adopting the vector signal may be used instead of the drawing sensing structure adopting the switch-value signal. That is, the sense mark 61 is a vectorial sense mark, and the sensor 62 is a vectorial sensor.

In this specific embodiment, the upper sense mark and the lower sense mark may be the N pole 611 and the S pole 612 of the magnet respectively. Of course, in other embodiments, the upper sense mark and the lower sense mark may be the S pole and the N pole of the magnet, respectively.

In this specific embodiment, the N pole 611 and the S pole 612 may be realized by a magnetic ring 6. The magnetic ring 6 may be fixedly sleeved on the drawing hose 2. The two ends of the magnetic ring 6 may be respectively the N pole 611 and the S pole 612, and the N pole 611 may be facing up, the S pole 612 may be facing down. The length of the magnetic ring 6 can be adjusted and changed according to the actual use experience. The interval space can affect and determine how long the shower head 31 is drawn to switch water discharge control mode.

The magnetic ring 6 in FIGS. 6 and 7 adopts a simplified drawing method and does not reflect the specific fixing structure. The fixing method of the magnetic ring 6 can be fixed by various existing fixing structures, such as the fixing structure of the magnetic ring in the first embodiment. Of course, in some other embodiments, the magnetic ring 6 can also be fixedly sleeved on the drawing hose at intervals by other means such as bonding, welding.

Of course, in other embodiments, the N pole 611 and the S pole 612 can also be realized by other magnet structures, such as a long magnet, the two ends of the magnet may be respectively the N pole and the S pole.

The sensor 62 may be a magnetic pole determiner. In this specific embodiment, the sensor 62 may be implemented by a bipolar Hall element. The bipolar Hall element may be fixedly provided in the faucet body and may be located at one side of the moving path of the N pole 611 and the S pole 612. The output terminal of the bipolar Hall element may be connected to the input terminal of the automatic water discharge control unit, but it is not limited to this.

The working principle of this embodiment is:

During the drawing process of the shower head 31 (at this time, the automatic water discharge control unit is in the state of turning off the water discharge), the drawing hose 2 drives the N pole 611 and the S pole 612 to move upwards. When the shower head 31 is drawn out for a certain distance, the N pole 611 and S pole 612 may be sensed when passing through the sensing area of the bipolar Hall sensor, and output two sense mark movement signals at intervals (the first set of sensing signals) to the control panel of the water control unit, the water control unit may control to turn on water discharge only after the first sense mark movement signal is delayed after the second sense mark movement signal, and the shower head 31 discharges water, so that the shower head 31 is drawn out for a certain distance before the water discharge. In the process of retracting the shower head 31 (at this time, the automatic water discharge control unit is in the state of turning off water discharge), the N pole 611 and the S pole 612 move down, the S pole 612 and the N pole 611 may be sensed when passing through the sensing area of the Hall sensor in turn, and output two sense mark movement signals (the second set of sensing signals) at intervals to control panel of the water control unit. The control panel controls the solenoid valve to turn off the water discharge after the first sense mark movement signal, and maintain turning off and reset the position after the second sense mark movement signal, such that the shower head 31 turns off water discharge in advance of the reset process.

This embodiment not only realizes that the shower head 31 is drawn out for a certain distance before discharging, and the water is turned off in advance during the reset process of the shower head 31, but also the sequence of the N pole 611 and the S pole 612 can be sensed, to accurately determine whether the shower head 31 is drawn out or received, to avoid misinduction and affect the user experience.

Embodiment 7

Figure 8:
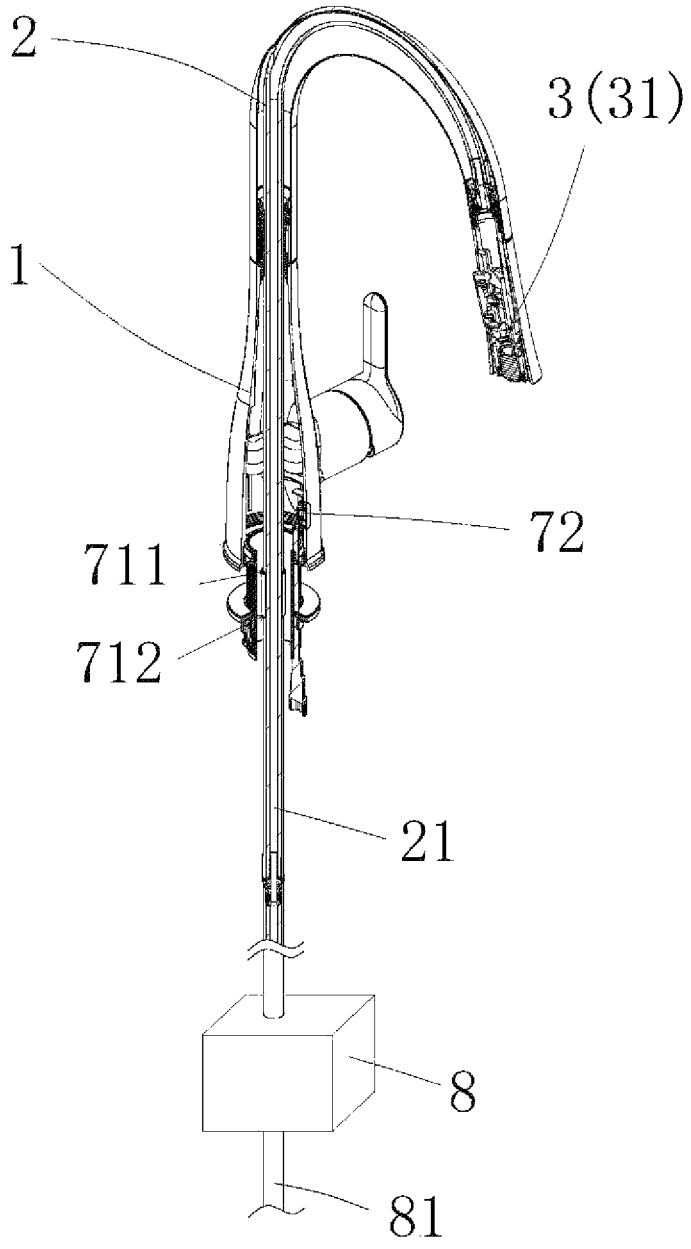
FIG. 8 is a cross-sectional structural view showing a drawing faucet according to the seventh embodiment of the present disclosure.
Figure 9:
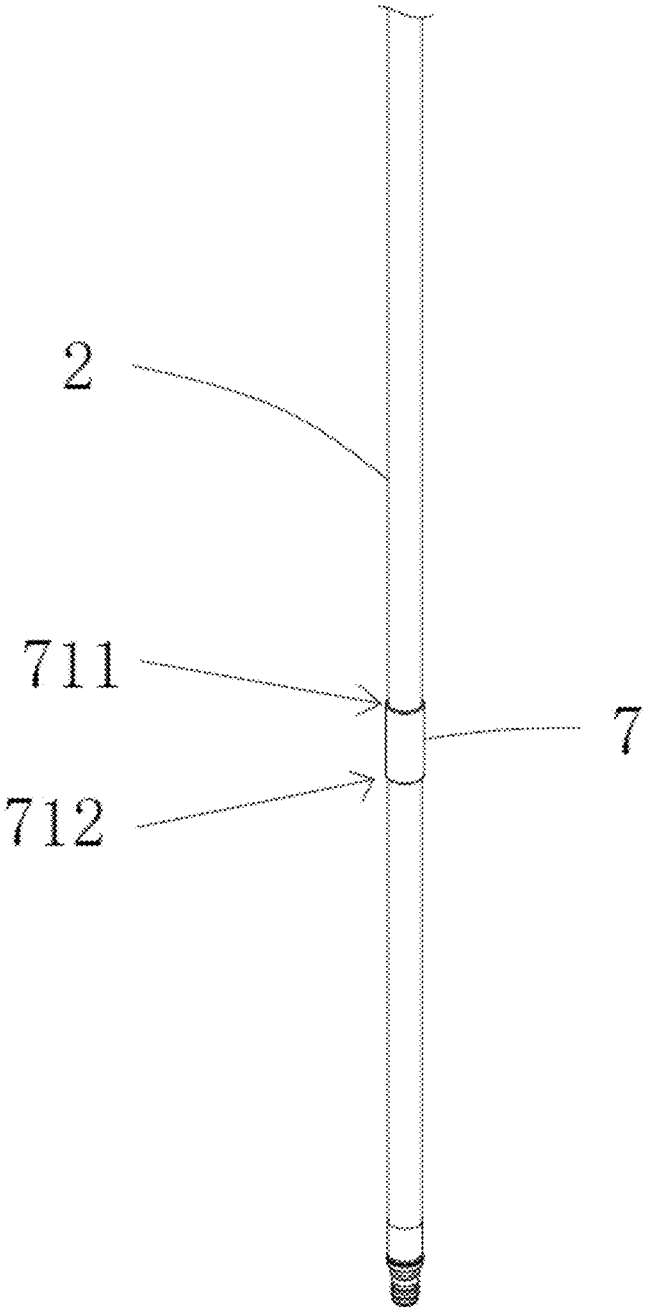
FIG. 9 is a structural diagram showing a drawing hose and a color ring according to the seventh embodiment of the present disclosure.

As shown in FIGS. 8 and 9, most elements of this embodiment are the same as those of the first embodiment. The main difference is that: the upper sense mark 711 and the lower sense mark 712 may be color marks, and the sensor 72 can be a photoelectric sensor for sensing color change.

The interval space between the upper sense mark 711 and the lower sense mark 712 can be adjusted and changed according to actual use experience. The interval space can affect and determine how long the shower head 31 is drawn to switch the water discharge control mode.

In this embodiment, each of the upper sense mark 711 and the lower sense mark 712 may be composed of a color ring 7 provided on the outer peripheral surface of the drawing hose 2, and the color of the color ring 7 may be different from the color of the drawing hose 2. The interface between the upper end of the color ring 7 and the outer peripheral surface of the drawing hose 2 may be the upper sense mark 711. During the drawing hose 2 is moving, when the sensing area of the outer peripheral surface of the drawing hose 2 located in the photoelectric sensor is changed to the sensing area of the upper end of the color ring 7 entering the photoelectric sensor, the photoelectric sensor will output a rising edge signal or a descending edge signal. The interface between the lower end of the color ring 7 and the outer peripheral surface of the drawing hose 2 may be the lower sense mark 712, when the sensing area of the lower end of the color ring 7 located in the photoelectric sensor is changed to the sensing area of the outer peripheral surface of the drawing hose 2 entering the photoelectric sensor, the photoelectric sensor will output a descending edge signal or a rising edge signal.

In this specific embodiment, the color ring 7 may be preferably formed by coating paint, that is easy to implement with good stability, and it can avoid the complicated fixing structure of the above-mentioned embodiment. Of course, in other embodiments, the color ring 7 can also be made of stickers or other manners.

The color of the color ring 7 can be selected according to the actual situation, as long as it is different from the color of the outer peripheral surface of the drawing hose 2. Of course, the larger the color difference, the better. If the outer peripheral surface of the drawing hose 2 is white, the color ring 7 can be black; when the outer peripheral surface of the drawing hose 2 is black, and the color ring 7 can be white.

The photoelectric sensor can use an infrared photoelectric sensor, including an infrared emitting tube and a light intensity detector. The light intensity detector may be used to detect the infrared light intensity of light emitted by the infrared emitting tube and reflected by the outer circumference of the drawing hose or the color ring. The output terminal of the detector may be connected to the input terminal of the automatic water discharge control unit.

The working principle of this embodiment is:

During the drawing process of the shower head 31 (at this time, the automatic water discharge control unit is in the state of turning off the water discharge), the drawing hose 2 drives the color ring 7 to move upwards. When the shower head 31 is drawn out for a certain distance, the photoelectric sensor sequentially senses the outer peripheral surface of the drawing hose 2, color ring 7, the outer peripheral surface of the drawing hose 2, and output a rising edge signal (the first sense mark movement signal) and a descending edge signal (the second sense mark movement signal) at intervals, or the descending edge signal (the first sense mark movement signal) and the rising edge signal (the second sense mark movement signal) to the control panel of the water control unit. The control panel may control to turning on the water discharge after the first sense mark movement signal is delayed after the second sense mark movement signal, such that the shower head 31 discharges water to realize that the shower head 31 is drawn out for a certain distance before the water discharge. When the shower head 31 is retracted (at this time, the automatic water discharge control unit is in the state of turning on water discharge), the drawing hose 2 drives the color ring 7 to move down, the photoelectric sensor in turn senses the outer peripheral surface of the drawing hose 2, the color ring 7, and the outer peripheral surface of the drawing hose 2, and outputs a rising edge signal (the first sense mark movement signal) and a descending edge signal (the second sense mark movement signal) at intervals, or the descending edge signal (the first sense mark movement signal) and the rising edge signal (the second sense mark movement signal) to the control panel of the water control unit. The control panel may control the solenoid valve to turn off the water discharge after the first sense mark movement signal, and maintains the shut down of the water discharge after the second sense mark movement signal and resets the position, so that the water has been turned off in advance during the reset process of the shower head 31.

Of course, in some embodiments, the upper sense mark 711 and the lower sense mark 712 can be realized by two color rings respectively (at this time, the sensing signal of each sense mark may be a pulse signal). The two color rings may be provided along the outer peripheral surface of the drawing hose in a length direction of the drawing hose at intervals. The interval space between the two color rings can be adjusted and changed according to the needs of the actual use experience. The interval space can affect and determine how long the shower head 31 is drawn out to switch the water discharge control mode.

Embodiment 8

Most elements of this embodiment and the seventh embodiment are the same. The main difference is that: the drawing sensing structure adopting the vector signal may be used to replace the drawing sensing structure adopting the switch-value signal; that is, the sense mark of this embodiment may be vectorial sense mark, the sensor may be a vectorial sensor.

Specifically, in this embodiment, the upper sense mark and the lower sense mark may be respectively realized by two color rings of different colors. The two color rings may be provided on the outer peripheral surface of the drawing hose at intervals along the length direction of the drawing hose. The setting of the interval space of the color ring can be adjusted and changed according to the needs of the actual use experience. The interval space can affect and determine how long the shower head is drawn to switch the water discharge control mode.

The photoelectric sensor can detect the different colors of the upper sense mark and the lower sense mark, so as to distinguish whether it is the upper sense mark or the lower sense mark. According to the sensing sequence of the upper sense mark and the lower sense mark, it can be determined whether the shower head is drawn out or reset, such that the on/off and/or opening of the solenoid valve can be better controlled, to avoid miscontrol, and improve the use experience.

The photoelectric sensor can be realized by selecting a photoelectric sensor with high sensitivity analog output followed by an ADC module. The automatic water discharge control unit distinguishes the upper sense mark and the lower sense mark according to the value of the ADC module, but it is not limited to this.

Although the present disclosure is specifically shown and described in combination with the preferred embodiments, those skilled in the art should understand that all various changes to the present disclosure in form and detail without departing from the spirit and scope of the present disclosure as defined by the appended claims fall within the protection scope of the present disclosure.

What is claimed is:

1. A drawing faucet, comprising a faucet body, a drawing hose, an automatic water discharge control unit, and a drawing sensing structure; wherein the drawing hose retracts in the faucet body, and a water inlet end of the drawing hose is connected to a water outlet end of the automatic water discharge control unit;

the drawing sensing structure comprises sense marks and a sensor; at least two sense marks are on the drawing hose and at intervals along a length direction of the drawing hose, the sense marks at two ends in the length direction are respectively defined as an upper sense mark and a lower sense mark; the sensor is configured to sense movements of the sense marks;

during a drawing process of the drawing hose, at least the upper sense mark and the lower sense mark follow a movement of the drawing hose and are sensed by the sensor, such that a first set of sensing signals and a second set of sensing signals are generated during the drawing process of the drawing hose, and the automatic water discharge control unit controls the water outlet end to change water discharge strategies accordingly based on the first set of sensing signals or the second set of sensing signals.

2. The drawing faucet according to claim 1, wherein: the strategies to change the water discharge are to turn on the water discharge and to turn off the water discharge.

3. The drawing faucet according to claim 2, wherein: when two sense marks are provided, that the automatic water discharge control unit controls the water outlet end to change water discharge strategies accordingly based on the first set of sensing signals or the second set of sensing signals is specifically:

when the automatic water discharge control unit is in a state of turning off the water discharge, two sense mark movement signals at interval are the first set of sensing signals, and the water discharge is controlled to be turned on after a first sense mark movement signal is delayed after the second sense mark movement signal;

when the automatic water discharge control unit is in a state of turning on the water discharge, the two sense mark movement signals at interval are the second set of sensing signals, and the water discharge is controlled to be turned off after the first sense mark movement signal, and kept to be turned off and reset after the second sense mark movement signal.

4. The drawing faucet according to claim 2, wherein: the sense mark is a switch-value sense mark, the sensor is a switch-value sensor; or the sense mark is a vectorial sense mark, the sensor is a vectorial sensor.

5. The drawing faucet according to claim 1, wherein: the sense mark is a switch-value sense mark, the sensor is a switch-value sensor; or the sense mark is a vectorial sense mark, the sensor is a vectorial sensor.

6. The drawing faucet according to claim 5, wherein: when the sense mark is selected as the switch-value sense mark, and the sensor is selected as the switch-value sensor, the sense marks are made of permanent magnet materials, the sensor is a magnetic switch.

7. The drawing faucet according to claim 6, wherein: the magnetic switch is a reed switch or a Hall sensor.

8. The drawing faucet according to claim 6, wherein: the permanent magnet has a ring structure fixedly sleeved on the drawing hose.

9. The drawing faucet according to claim 5, wherein: when the sense mark is selected as the vectorial sense mark, and the sensor is selected as the vectorial sensor, the sense marks are made of permanent magnet materials with different magnetic fields, the sensor is a magnetic field detecting device.

10. The drawing faucet according to claim 9, wherein: the magnetic field detecting device is a Hall sensor.

11. The drawing faucet according to claim 9, wherein: the permanent magnet has a ring structure fixedly sleeved on the drawing hose.

12. The drawing faucet according to claim 5, wherein: when the sense mark is selected as the switch-value sense mark, and the sensor is selected as the switch-value sensor, the sense mark is a degaussing unit; the sensor comprises a magnetic unit and a magnetic switch, the magnetic unit and the magnetic switch are provided in the faucet body and are respectively located on opposite sides of the drawing hose; the magnetic switch is configured to sense the magnetic unit; when the degaussing unit is located between the magnetic unit and the magnetic switch, a sense of the magnetic switch to the magnetic unit is shielded.

13. The drawing faucet according to claim 12, wherein: the sense mark has a ring structure fixedly sleeved on the drawing hose.

14. The drawing faucet according to claim 12, wherein: the magnetic switch is a reed switch or a Hall sensor.

15. The drawing faucet according to claim 5, wherein: when the sense mark is selected as the vectorial sense mark, and the sensor is selected as the vectorial sensor, the sense marks are respectively composed of different magnetic poles of a magnet, and the sensor is a magnetic pole determiner.

16. The drawing faucet according to claim 5, wherein: when the sense mark is selected as the switch-value sense mark, and the sensor is selected as the switch-value sensor, the sense mark is a color mark, and the sensor is a photoelectric sensor.

17. The drawing faucet according to claim 16, wherein the sense mark is formed by arranging a color ring on an outer peripheral surface of the drawing hose, and a color of the color ring is different from a color of the drawing hose.

18. The drawing faucet according to claim 17, wherein: the color ring is formed by a sticker or paint.

19. The drawing faucet according to claim 5, wherein: when the sense marks are selected as the vectorial sense marks, and the sensor is selected as the vectorial sensor, the sense marks are color marks, and a color of each color mark is different, and the sensor is a photoelectric sensor.

* * * * *